US007877920B2

(12) United States Patent
Szuminski et al.

(10) Patent No.: US 7,877,920 B2
(45) Date of Patent: Feb. 1, 2011

(54) DOOR-MOUNTED RIFLE RACK

(75) Inventors: Dale M. Szuminski, Byron, IL (US); Richard E. Stepp, Provo, UT (US); Lyle K. Evans, Spanish Fork, UT (US)

(73) Assignee: Provo Steel & Supply Co., Provo, UT (US)

( * ) Notice: Subject to any disclaimer, the term of this patent is extended or adjusted under 35 U.S.C. 154(b) by 0 days.

(21) Appl. No.: 10/971,584

(22) Filed: Oct. 22, 2004

(65) Prior Publication Data

US 2005/0115912 A1 Jun. 2, 2005

Related U.S. Application Data

(60) Provisional application No. 60/513,967, filed on Oct. 24, 2003.

(51) Int. Cl.
*F41A 17/00* (2006.01)
*A47F 7/00* (2006.01)

(52) U.S. Cl. ..... 42/70.01; 42/70.11; 211/4; 211/64; 109/51; 206/315.11

(58) Field of Classification Search ..... 42/70.01, 42/70.11; 211/64, 4; 109/50, 51; 206/315.11
See application file for complete search history.

(56) References Cited

U.S. PATENT DOCUMENTS

| | | | | |
|---|---|---|---|---|
| 3,421,632 | A | 1/1969 | Wood | |
| 3,822,925 | A | 7/1974 | Osroff | |
| 3,918,670 | A | 11/1975 | Doherty | |
| 3,997,219 | A | 12/1976 | Phelps | |
| 4,057,180 | A | 11/1977 | Whittaker | |
| 4,095,860 | A | 6/1978 | Henson | |
| 4,099,808 | A * | 7/1978 | Oakley et al. | 312/297 |
| 4,197,951 | A | 4/1980 | Shassere | |
| 4,236,772 | A | 12/1980 | Henson | |
| 4,304,447 | A | 12/1981 | Ellwood | |
| 4,396,240 | A | 8/1983 | Henson | |

(Continued)

FOREIGN PATENT DOCUMENTS

| | | |
|---|---|---|
| EP | 0962731 | 12/1999 |

OTHER PUBLICATIONS http://web.archive.org/web/20060715224642/outdoorsuperstore.com and http://www.outdoorsuperstore.com/product.asp?manufacturer=Browning&model=Ultimate+Interior/ Apr. 19, 2003.*

(Continued)

*Primary Examiner*—J. Woodrow Eldred
(74) *Attorney, Agent, or Firm*—Ostranger Chong Flaherty & Broitman P.C.

(57) ABSTRACT

A door-mounted rifle rack for use with a gun safe. The rifle rack has a stock support having one or more butt recesses located on a lower portion of an interior surface of the safe door. The butt recesses may be postioned at an angle to the interior surface of the safe door. A barrel support having one or more barrel holes is located on an upper portion of the interior surface of the safe door above the stock support. The barrel support, alternatively, may have one or more barrel recesses provided with barrel restraints instead of barrel holes.

12 Claims, 8 Drawing Sheets

U.S. PATENT DOCUMENTS

| | | | | |
|---|---|---|---|---|
| 4,502,742 | A | 3/1985 | Neff | |
| 4,585,127 | A | 4/1986 | Benedict | |
| D287,550 | S | 1/1987 | Tocci | |
| 4,776,650 | A | 10/1988 | Ferenzi | |
| 4,796,762 | A | 1/1989 | Law | |
| D300,398 | S | 3/1989 | Krugman | |
| 4,859,084 | A | 8/1989 | Kaumeyer | |
| D305,153 | S | 12/1989 | Elderkin | |
| 4,949,843 | A | 8/1990 | Stokes | |
| 4,953,765 | A | 9/1990 | Little | |
| 4,978,001 | A | 12/1990 | Nelson | |
| 4,986,427 | A | 1/1991 | Law | |
| 5,076,442 | A | 12/1991 | Hakeem | |
| 5,158,186 | A | 10/1992 | Krut | |
| 5,163,745 | A | 11/1992 | Zagata | |
| D335,233 | S | 5/1993 | Long | |
| D337,467 | S | 7/1993 | Schmidt | |
| 5,246,103 | A | 9/1993 | Hicks | |
| D343,970 | S | 2/1994 | Campbell | |
| 5,282,539 | A | 2/1994 | Saathoff | |
| D354,412 | S | 1/1995 | Emery | |
| 5,477,967 | A | 12/1995 | Voorhees | |
| 5,495,969 | A | 3/1996 | Cardenas | |
| 5,511,873 | A | 4/1996 | Mech | |
| 5,626,379 | A | 5/1997 | Scott | |
| 5,645,178 | A | 7/1997 | Conley, Jr. | |
| 5,685,624 | A | 11/1997 | Lee | |
| 5,695,073 | A | 12/1997 | Klein | |
| 5,758,936 | A | 6/1998 | Baughan | |
| 5,797,500 | A | 8/1998 | Lacoste | |
| 5,887,730 | A | 3/1999 | St. George | |
| 5,894,940 | A | 4/1999 | Gusdorf | |
| 5,957,308 | A * | 9/1999 | Zierenberg | 211/64 |
| D429,897 | S | 8/2000 | Rogman | |
| D429,938 | S | 8/2000 | Allen | |
| 6,098,815 | A | 8/2000 | Nesser | |
| 6,126,021 | A | 10/2000 | Wilhite | |
| 6,138,841 | A | 10/2000 | Klein | |
| 6,238,030 | B1 | 5/2001 | Matselboba | |
| 6,302,052 | B1 * | 10/2001 | Sauerwein | 114/351 |
| 6,361,130 | B1 | 3/2002 | Kardy | |
| 6,386,379 | B1 | 5/2002 | Battaglia | |
| 6,394,287 | B2 | 5/2002 | Cabrera | |
| 6,464,086 | B1 | 10/2002 | Klein | |
| 6,467,613 | B2 | 10/2002 | Felsenthal | |
| 6,533,127 | B1 | 3/2003 | Klein | |
| 6,581,786 | B1 | 6/2003 | King | |
| D499,286 | S | 12/2004 | Harwanko | |
| D501,106 | S | 1/2005 | Suero, Jr. | |
| 6,857,528 | B2 | 2/2005 | Klein | |
| 6,868,975 | B2 * | 3/2005 | Sells et al. | 211/4 |
| 6,997,526 | B2 | 2/2006 | Leimkuehler | |
| 7,478,892 | B2 | 1/2009 | Punzel | |
| 2003/0011291 | A1 | 1/2003 | Moreno-Olugin | |
| 2003/0085188 | A1 | 5/2003 | Klein | |
| 2003/0213720 | A1 | 11/2003 | Nesselrodt | |
| 2004/0124116 | A1 | 7/2004 | Long | |
| 2004/0130250 | A1 | 7/2004 | Cleveland | |
| 2004/0140235 | A1 * | 7/2004 | Cleveland et al. | 206/315.11 |
| 2004/0140280 | A1 * | 7/2004 | Cleveland et al. | 211/64 |
| 2004/0183416 | A1 | 9/2004 | Becke | |
| 2004/0222125 | A1 | 11/2004 | Meing | |
| 2005/0133473 | A1 * | 6/2005 | Lesperance | 211/64 |
| 2006/0186775 | A1 | 8/2006 | Becke | |

OTHER PUBLICATIONS

Buckmasters Online Magazine, "New Products", web page url <http://www.buckmasters.com/ Buckmasters_links/ New_Products/NPSentryRU9889.html>, p. 1, printout dated Oct. 18, 2004.

Liberty Safe, "About Liberty Safe", web page url <http:www. libertysafe.com/about.lasso?-Token.link=4in1flex>, p. 1, printout dated Oct. 18, 2004.

Arizona Safe Keeper, "Gun Safe Accessories", web page url <http:// www.arizonasafekeeper.com/skpistol.html>, p. 1, printout dated Oct. 18, 2004.

Sentry Group, Gun Safe/Executive Safe Owner's Manual, web page url <http://www.sentrysafe.com/pdfs/ownersmanuals/172752.pdf>.

Photographs from 2002 Shooting, Hunting, Outdoor Trade Show and Conference ("SHOT Show"—Owned and Sponsored by National Shooting Sports Foundation), DPMS safe on p. 5 of 6.

Heritage Safe Co. 1999 Brochure, page displaying safes and inside of safes.

* cited by examiner

30

36
30

DOOR-MOUNTED RIFLE RACK

PRIORITY CLAIM

This application claims priority from U.S. Provisional Patent Application No. 60/513,967 filed on Oct. 24, 2003.

FIELD OF INVENTION

This invention generally relates to an apparatus for holding guns and other items in a gun safe. Specifically, the invention relates to a door-mounted rifle rack for providing easier access to rifles held within the gun safe.

BACKGROUND OF INVENTION

The use of gun safes for storing and preventing unauthorized access to firearms and ammunition is well known. Rifles are generally stored in racks located in the interior of the safe. See, FIG. 1. It is also well known to attach devices to the interior surface of safe doors in order provide additional means for storing firearms and accessories. For example, U.S. Pat. No. 5,957,308 to Zierenberg discloses a system for hanging pistols from the interior surface of a safe door. The Sentry® FIRE-SAFE® Gun Safe: Model GT8423 discloses the use of hooks and restraint cords for attaching items such as spare gun barrels and pistols to interior surface of a safe door. However, all of these devices require that rifles are stored in the interior of the safe. Thus, rifles are not easily accessible. Further, since rifles are stored close together, it increases the danger of damages (e.g., nicks and scratches) to the rifles. Accordingly, it is a broad object of the invention to provide a door-mounted rifle rack for use with the interior surface of the door of a gun safe. This would allow rifles to be easily accessible and would minimize damage to the rifles.

SUMMARY OF INVENTION

In the present invention, the foregoing purposes, as well as others that will be apparent, are achieved generally by providing a door-mounted rifle rack comprising a barrel support and a stock support. The stock support is located on a lower portion of an interior surface of the door of a gun safe. One or more butt recesses are disposed on the stock support for receiving and securing the butt end of a rifle stock. The barrel support is disposed on an upper portion of the interior surface of the safe door at a distance above the stock support.

The barrel support has one or more barrel holes for receiving and securing a rifle barrel. It is to be understood that the term "rifle" as used herein generally refers to a firearm with an elongated barrel and a stock having a butt. Thus, the term "rifle" refers not only to rifles but also includes shotguns, carbines and other similar firearms.

DESCRIPTION OF PREFERRED EMBODIMENTS

Figure 1:
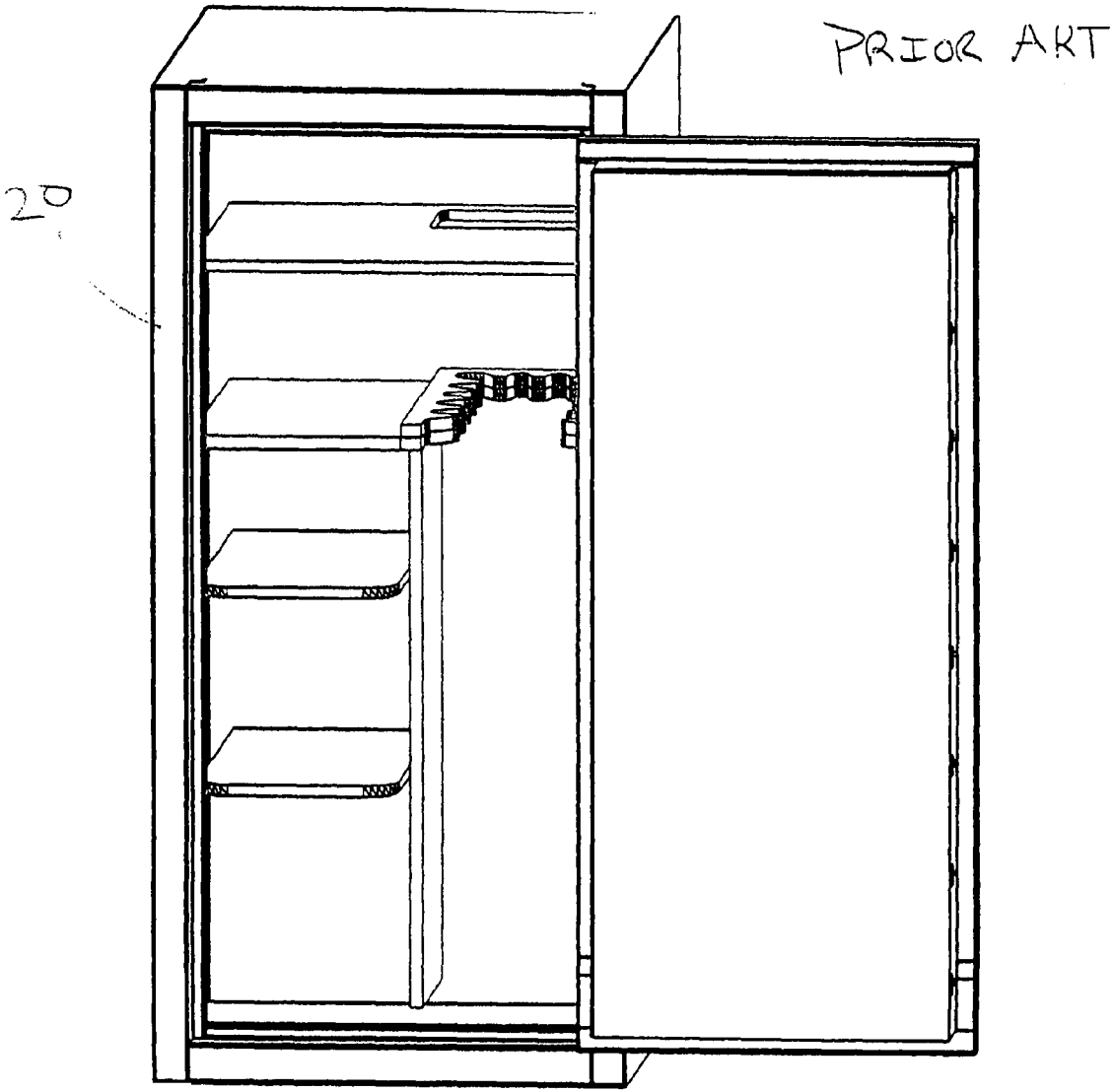
FIG. 1 is a front elevational view of a gun safe of the prior art with the safe door in the open position.
Figure 2:
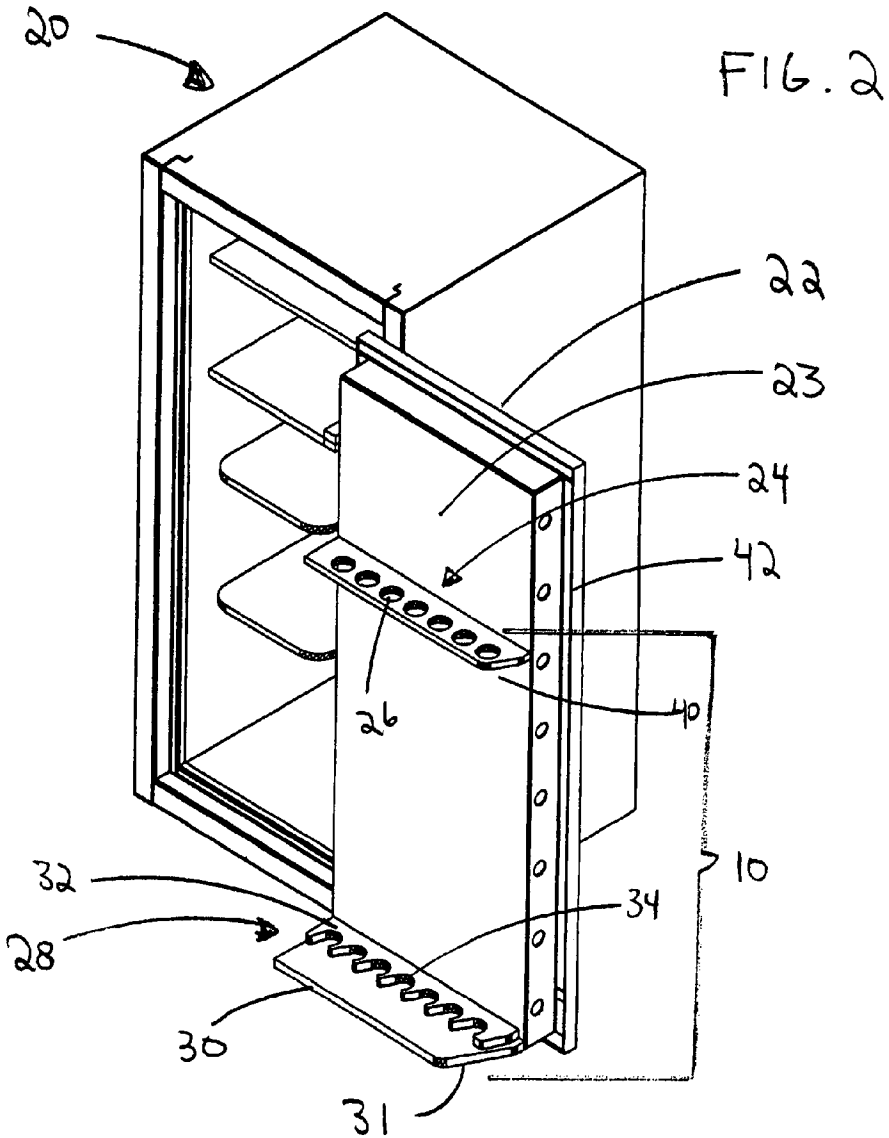
FIG. 2 is a front elevantional view of a rifle rack embodying features of the present invention mounted on an interior surface of the door of a gun safe.

A rifle rack 10 and a gun safe 20 with a safe door 22 in an open position are generally shown in FIG. 2. The rifle rack 10 generally comprises a top rack or barrel support 24 and a bottom rack or stock support 28. The stock support 28 is disposed on a bottom portion of an interior surface 23 of the safe door. The stock support 28 receives and holds a butt end of the stock of a rifle (not shown) in place. The barrel support 24 is disposed on an upper portion of the interior surface 23 of the safe door at a distance above the stock support 28. The barrel support 24 receives and holds the barrel of the rifle in place.

Figure 4:
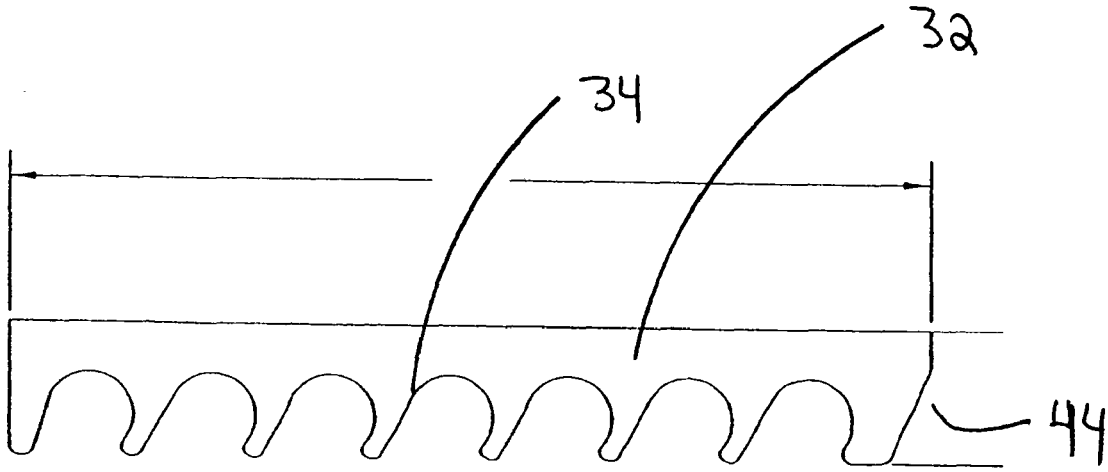
FIG. 4 is a top plan view of a butt rack of a rifle rack embodying features of the present invention.
Figures 5A, 5B:
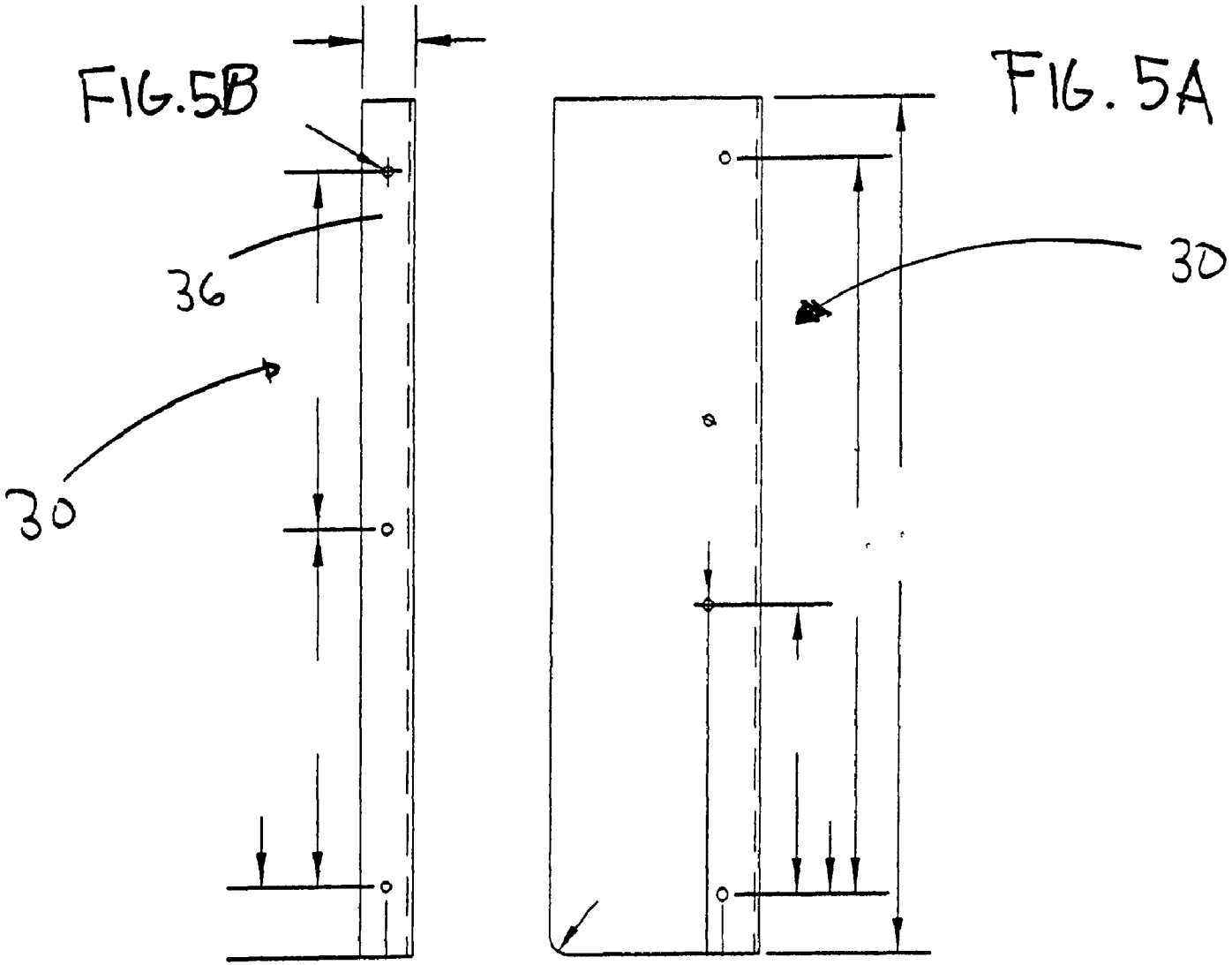
FIG. 5A is a top plan view of a floor of a rifle rack embodying features of the present invention.
FIG. 5B is a rear plan view of the floor of FIG. 5A
Figure 6:
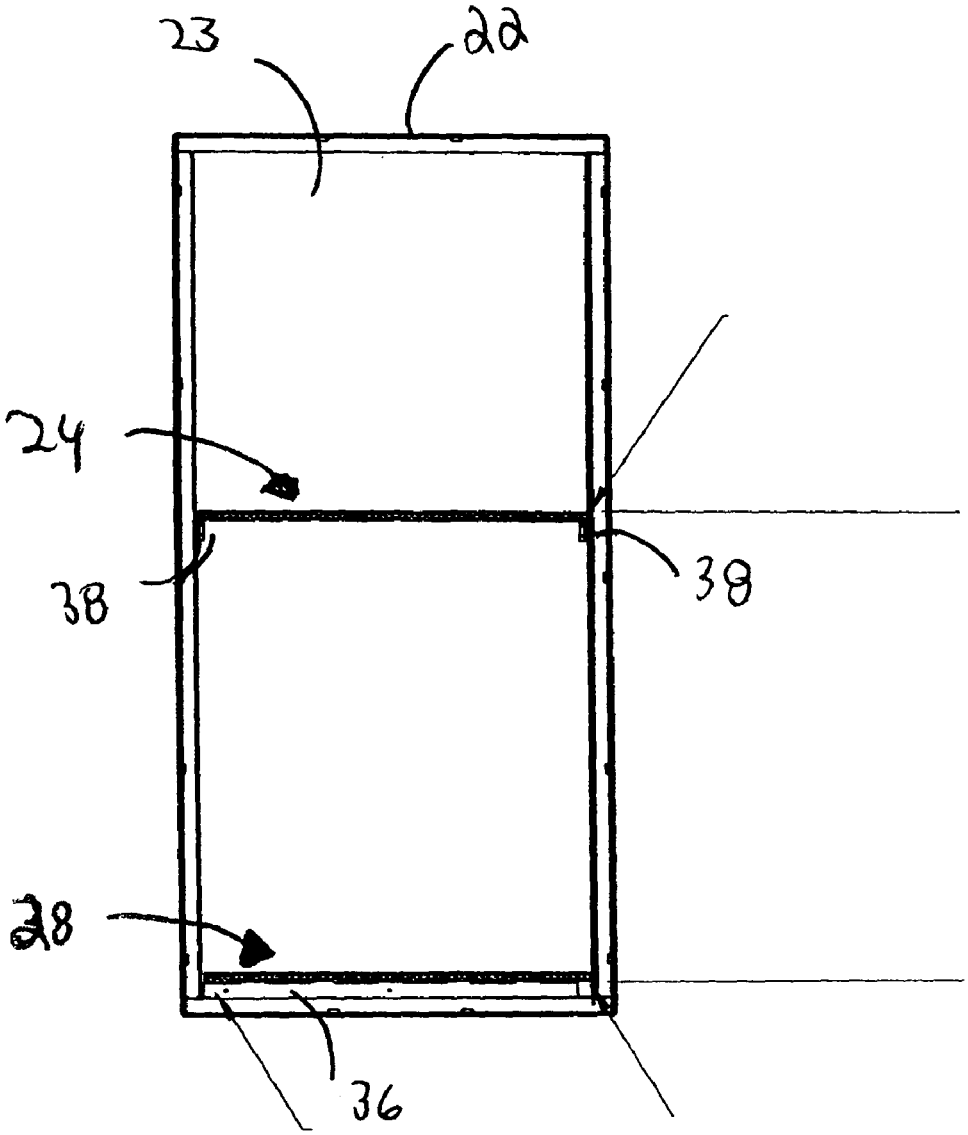
FIG. 6 is a front plan view of the interior surface of the door of the gun safe of FIG. 2.

Referring to FIGS. 2, and 4-6, the stock support 28 comprises a butt rack 32 (FIG. 4) having one or more butt recesses 34 and a floor 30 (FIGS. 5A, 5B). The butt rack 32 comprises a generally rectangular member having a planar surface. The butt rack 32 is sized, shaped, constructed and arranged (hereafter collectively, "dimensioned") so that it can receive and securely hold rifle stocks without interfering with the opening and closing of the safe door 22. Preferably, an outer corner 44 of the butt rack (see, FIGS. 2, 4) that is nearest to an outer edge 42 of the safe door is cut away in order to facilitate the opening and closing of the safe door.

Figure 7:
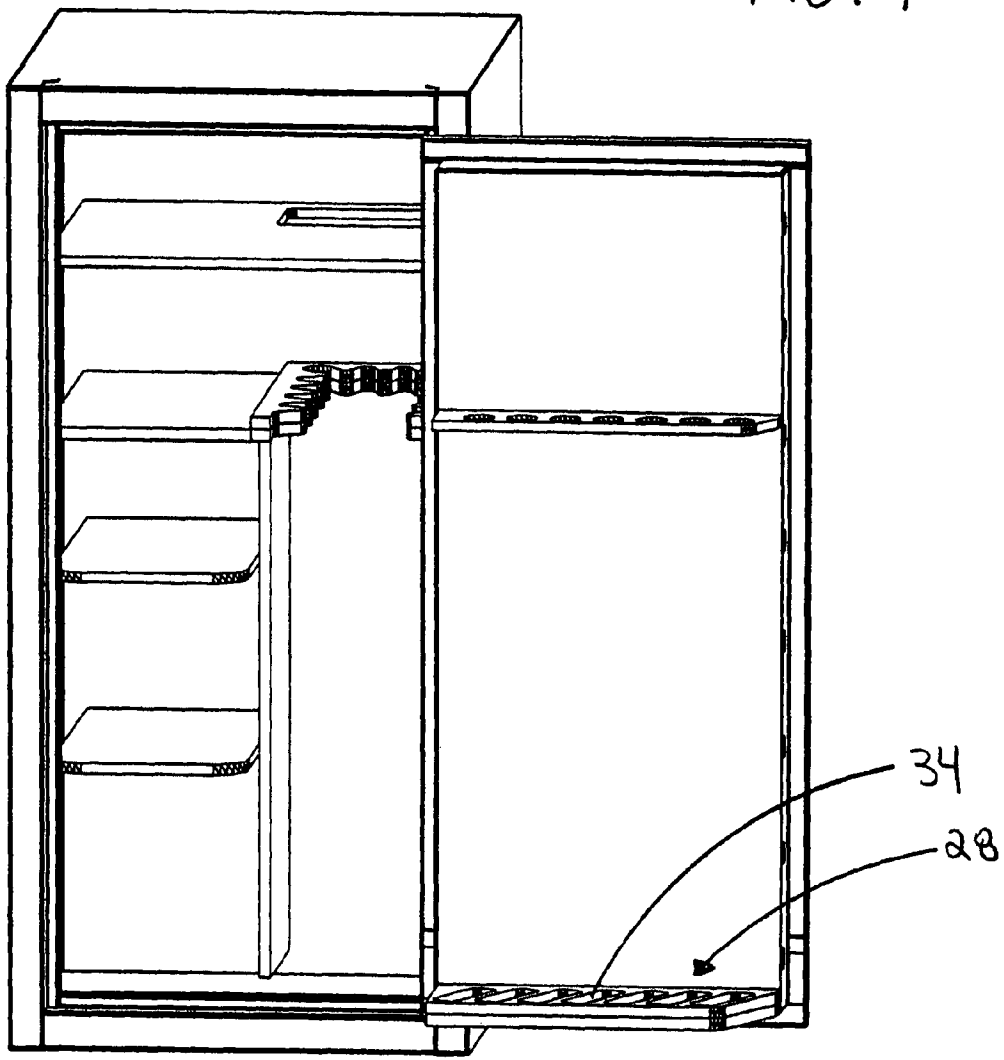
FIG. 7 is a front elevational view of an alternate embodiment of rifle rack embodying features of the present invention mounted on an interior surface of the door of a gun safe.

One or more butt recesses 34 are disposed on the butt rack 32 (FIG. 4). The butt recesses are dimensioned to receive, secure and support the butt end of the rifle stock. Preferably, the butt recesses 34 are U-shaped. (FIG. 4) However, in an alternate embodiment (FIG. 7), the butt recesses 34 are shaped in the form of an elongated slot. The butt recesses 34 are preferably disposed at an angle (FIGS. 2, 4) to the interior surface of the safe door 22. This arrangement allows more rifles to be mounted on the door rack 10.

The butt rack 32 is formed or shaped from a material suitable for use with rifle butts, e.g., wood or composite. Preferably, the butt rack 32 is formed from wafer board and appropriately dimensioned butt recesses 34 are cut out of the wafer board. The butt rack 32 is preferably covered by carpet material, padding or other similar material in order to protect rifles from damage.

The floor 30 is a generally rectangular shaped member having a flange 36. See, FIGS. 5A, 5B. The floor 30 is dimensioned so that it supports the butt rack and butts of the rifles mounted in the butt rack without interfering with the opening or closing of the safe door. Preferably, an outer corner 31 of the floor (see, FIG. 2) that is nearest to an outer edge 42 of the safe door is cut away to facilitate the opening and closing of the safe door. The floor is formed or shaped from material suitable for use with rifle stocks, e.g. wood or metal, preferably metal. Preferably, the floor is covered with carpet material, padding or other similar material in order to protect rifles from damage. The floor 30 is attached to the butt rack 32 with glue or fasteners such a screws, preferably with self tapping grabber screws.

Figure 3:
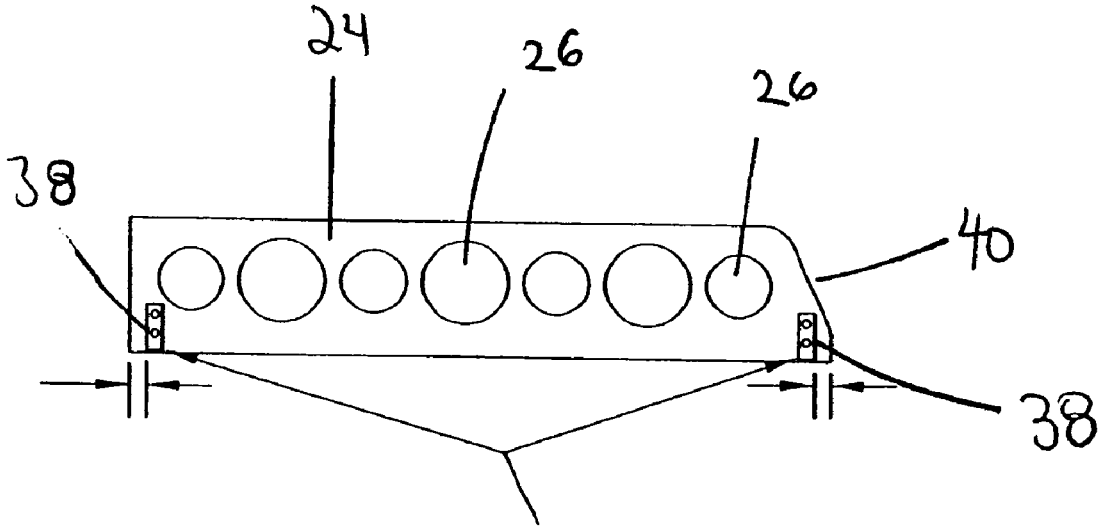
FIG. 3 is a bottom plan view of a barrel support of a rifle rack embodying features of the present invention.

Referring to FIGS. 2 and 3, the barrel support 24 comprises a generally rectangular member having a planar surface. The barrel support 24 is dimensioned to enable the barrel support to securely hold rifle barrels without interfering with the closing and opening of the safe door 22. Preferably, an outer corner 40 of the barrel support that is nearest to the outer edge 42 of the safe door is cut away to facilitate the opening and closing of the safe door.

The barrel support 24 has one or more generally circular barrel holes 26 for holding rifle barrels in place. The barrel holes 26 are dimensioned to allow rifle barrels to be easily inserted or removed from the barrel holes and to securely hold rifle barrels as the safe door opens and closes. Each barrel hole 26 is positioned on the barrel support 24 so that is registers with a corresponding butt recess 34 on the stock support 28 when the barrel support and butt support 28 are mounted on the safe door 22. See, FIG. 2. Each barrel hole coacts 26 with a corresponding butt recess 34 to receive, secure and hold a rifle upright on the rifle rack 10. Preferably, each barrel hole is provided with a barrel grommet (not shown) to protect the rifle barrel from damage. The grommet is made from plastic, rubber, or other similar material suitable for protecting rifle barrels.

In the embodiment shown in FIG. 3, the barrel support 24 has barrel holes 26 of varying diameters. This is to allow the barrel support to accommodate rifle barrels of varying dimensions. However, it is to be understood that a barrel support having uniformly sized barrel holes is within the scope of the present invention.

Figure 8:
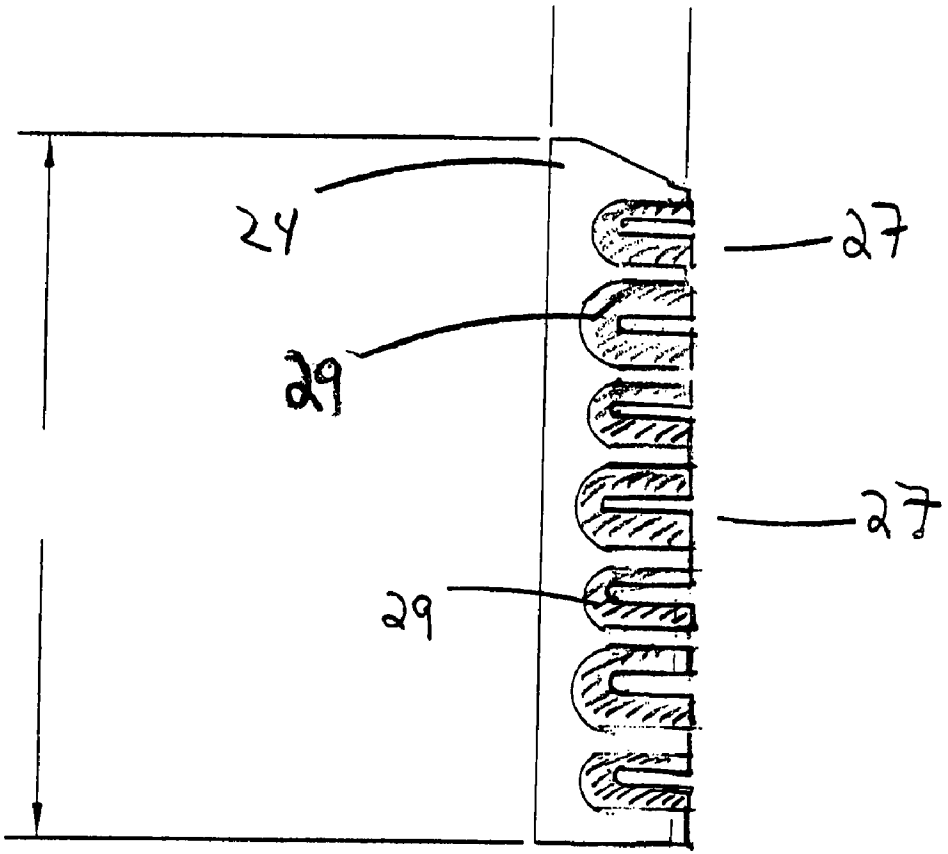
FIG. 8 is a top view of an alternate embodiment of a barrel support of a rifle rack embodying features of the present invention.

In an alternate embodiment (see, FIG. 8), instead of barrel holes, the barrel support has one or more generally, U-shaped barrel recesses 27. The barrel recesses are dimensioned to allow rifle barrels to be easily inserted or removed from the barrel recess also to securely hold rifle barrels as the safe door opens and closes. Preferably, the barrel recess has a barrel restraint 29 that allows the rifle barrel to be easily inserted or removed from the barrel recess and also holds the barrel in place as the safe door opens and closes. In a preferred embodiment, the barrel restraint 29 is a foam liner that lines the barrel recess. Alternately, flexible plastic or metal clips, shock cords, or latches that close the opening of the barrel recess may be used as a barrel restraint.

The barrel support 24 is formed or molded from a material suitable for use with rifle barrels, e.g. wood or composite. In a preferred embodiment, the barrel support is formed from wafer board. Barrel holes are formed by drilling appropriately sized holes in the wafer board. Preferably, the barrel support is covered by carpet material, padding or similar material in order to protect rifles from damage.

The door rack 10 is mounted on the safe door 22 as follows. See, FIGS. 2 and 6. The stock support 28 is mounted on the interior surface 23 of the safe door by attaching the flange 36 to the interior surface of the safe 20 by gluing, welding or with fasteners, preferably self tapping sheet metal screws that anchor into steel Z bars (not shown) that are attached to the safe door. The barrel support 24 is mounted on the upper portion of the interior surface 23 of the safe door by two spaced-apart brackets 38 (FIGS. 3, 6) that are attached to the interior surface of the door safe with fasteners such rivets or screws, preferably self-tapping sheet metal screws, which anchor into steel Z bars (not shown) attached to the safe door.

The barrel support 24 is positioned above the stock support 28 at a height sufficient to allow the barrel support and butt support to securely hold rifles of the size generally used by sportsmen, hunters and gun enthusiasts but still allow rifles to be easily placed into or removed from the rifle rack 10. In the embodiment shown in FIG. 2, the distance between the barrel support 24 and stock support 28 is about thirty-six inches. However, it is to be understood barrel supports and stock supports separated by a greater distance or lesser distance that allow the rifle rack to be used with longer or shorter rifles is within the scope of the present invention. A rifle (not shown) is stored in the rifle rack by first inserting the rifle barrel into the barrel hole 26 from below and then placing the rifle butt into the butt recess 34.

Although the invention has been described with reference to preferred embodiments, it will be appreciated by one of ordinary skill in the art that numerous modifications are possible in light of the above disclosure. For example, in an alternate embodiment (not shown) the butt support comprises a unitary structure having one or more butt recesses. In addition, one or more barrel holes may be provided with a locking means to limit access to particular rifles. In another alternate embodiment (not shown), the barrel support may be split cross-wise into two or more pieces that are mounted on the safe door at different heights above the stock support. This would enable rifles of varying lengths to be stored on the rifle rack. All such variations and modifications are intended to be within the scope and spirit of the invention.

What is claimed is:

1. A gun safe comprising:

an interior compartment defined by a top wall, a bottom wall and two side walls, the interior compartment providing interior storage means for storing rifles, guns or firearm accessories;

a single safe door having an interior surface, the safe door hingedly attached to one of the two side walls at an inner vertical edge of the safe door; and a rifle rack permanently mounted on the interior surface of the safe door such that the rifle rack does not interfere with the interior storage means or the two side walls, the rifle rack comprising a stock support positioned on a lower portion of the interior surface of the safe door and comprising at least one butt recess disposed at an acute angle relative to the interior surface of the safe door, and a barrel support positioned on an upper portion of the interior surface of the safe door for securing a barrel of a rifle, each of the stock support and the barrel support having an outer edge extending away from the interior surface of the safe door at a right angle and tapering to an acute angle relative to the interior surface of the door to form a cut-away portion in the outer edge of each of the barrel support and the stock support.

2. The gun safe of claim 1, wherein the stock support further comprises a second butt recess and further, wherein the barrel support comprises a first barrel hole with a first diameter and a second barrel hole having a second diameter, wherein the second diameter is greater than the first diameter.

3. The gun safe of claim 1, wherein the at least one butt recess is U-shaped.

4. The gun safe of claim 1, wherein the at least one butt recess is an elongated slot.

5. The gun safe of claim 2, further comprising a barrel grommet disposed in the first barrel hole.

6. The gun safe of claim 1, wherein the stock support comprises a floor and a butt rack supported on the floor, wherein the at least one butt recess is formed in the butt rack.

7. The gun safe of claim 1, wherein the barrel support comprises at least one barrel recess.

8. The gun safe of claim 7, further comprising a barrel restraint disposed in the first barrel recess.

9. The gun safe of claim 8, wherein the barrel restraint is a foam liner.

10. The gun safe of claim 1, wherein each of the stock support and the barrel support are dimensioned such that rifles mounted on the rifle rack do not interfere with opening and closing of the safe door.

11. The gun safe of claim 1, wherein the barrel support comprises at least one barrel hole dimensioned for insertion and removal of a rifle barrel, wherein said at least one barrel hole is positioned in the barrel support so that it registers with a corresponding butt recess on the stock support when the barrel support and stock support are mounted on the safe door.

12. The gun safe of claim 1 wherein the barrel support is split along a longitudinal length into two or more pieces for mounting on the safe door at different heights above the stock support enabling rifles of varying lengths to be stored on the rifle rack.

* * * * *